US005862570A

United States Patent [19]

Lezuch et al.

[11] Patent Number: 5,862,570

[45] Date of Patent: Jan. 26, 1999

[54] SELF LOCATING CHECK ARM ASSEMBLY

[75] Inventors: Lawrence J. Lezuch, Clinton Township; Maurice H. Allmacher, Warren, both of Mich.

[73] Assignee: Chrysler Corporation, Auburn Hills, Mich.

[21] Appl. No.: 660,552

[22] Filed: Jun. 10, 1996

[51] Int. Cl.[6] ..... E05C 17/18

[52] U.S. Cl. ..... 16/82; 16/86 C; 292/266; 292/262

[58] Field of Search ..... 16/82, 85, 86 R, 16/86 A, 86 B, 86 C, 255, 256, 286; 292/262, 266, 269

[56] References Cited

U.S. PATENT DOCUMENTS

| | | | |
|---|---|---|---|
| 2,032,600 | 3/1936 | Smith | 16/86 |
| 2,237,046 | 4/1941 | Breitenwischer | 16/85 |
| 2,290,331 | 7/1942 | Jacobs | 16/86 C |
| 2,321,409 | 6/1943 | Moore | 16/85 |
| 2,693,616 | 11/1954 | Cromwell et al. | 16/85 |
| 2,724,143 | 11/1955 | Galla | 16/86 |
| 2,787,019 | 4/1957 | Galla | 16/85 |
| 2,860,369 | 11/1958 | Galla | 16/85 |
| 2,980,945 | 4/1961 | Hollar | 16/85 |
| 3,012,269 | 12/1961 | Bartel | 16/86 |
| 3,051,983 | 9/1962 | Dale | 16/82 |
| 3,369,833 | 2/1968 | Schaldenbrand | 292/268 |
| 4,628,568 | 12/1986 | Lee et al. | 16/337 |
| 4,663,801 | 5/1987 | Malopolski, Jr. | 16/82 |
| 4,833,755 | 5/1989 | Bonin | 16/344 |
| 4,841,600 | 6/1989 | Sasamura et al. | 16/335 |
| 5,074,010 | 12/1991 | Gignac et al. | 16/334 |
| 5,152,030 | 10/1992 | Cogo | 16/86 |
| 5,173,991 | 12/1992 | Carswell | 16/86 |
| 5,474,344 | 12/1995 | Lee | 16/86 C |

*Primary Examiner*—Chuck Y. Mah
*Assistant Examiner*—Donald M. Gurley
*Attorney, Agent, or Firm*—Ronald A. Fuller III

[57] ABSTRACT

A self locating check arm assembly, including an elongated arm pivotally mounted to a base portion. A spring is provided for biasing the elongated arm toward a first position. A housing portion is provided having an opening therethrough for receiving the elongated arm. The housing supports arm engaging portions and is adapted to be mounted to a door of a vehicle. A surface locator defines the first position against which the elongated arm is biased by the spring. The self locating check arm allows a door to be fully opened without disabling the check arm whereby when the door is opened beyond a predetermined position, the elongated arm disengages from the housing and the elongated arm is biased by the spring against the surface locator such that an end of the elongated arm is properly aligned with the opening in the housing when the door is returned to the predetermined position and is automatically reengaged with the housing when the door is moved beyond the predetermined position toward a closed position.

18 Claims, 5 Drawing Sheets

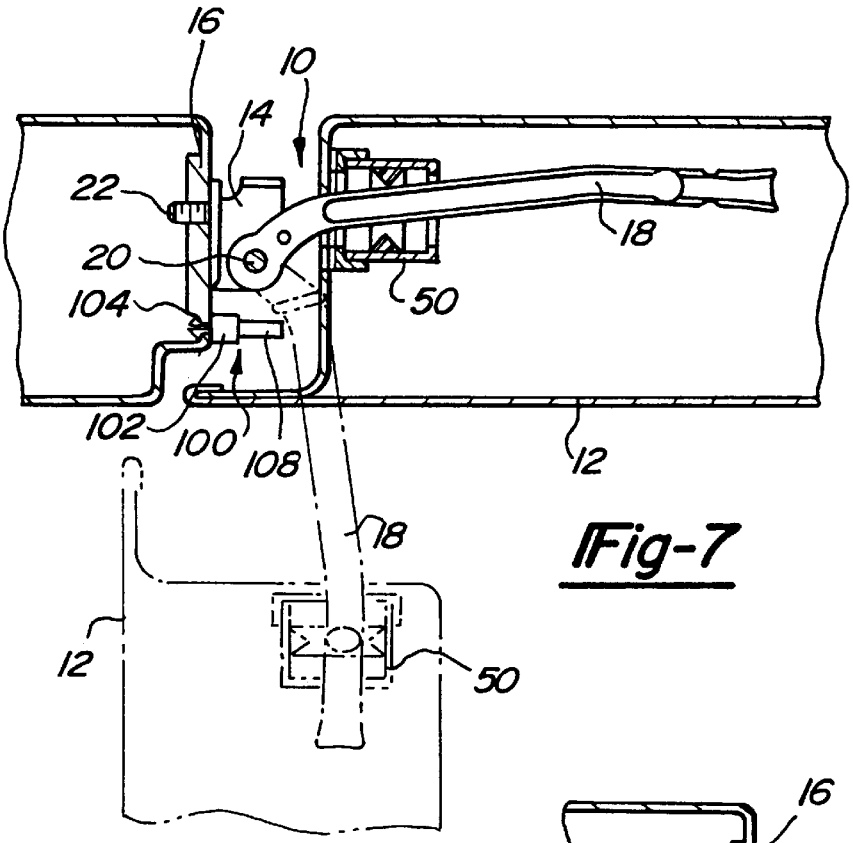
Fig-7
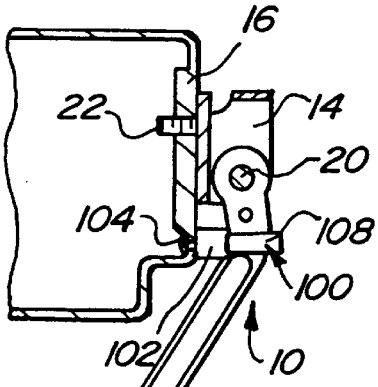
Fig-8
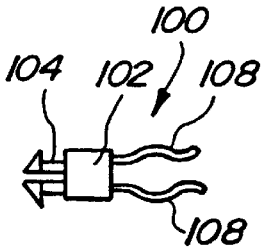
Fig-9
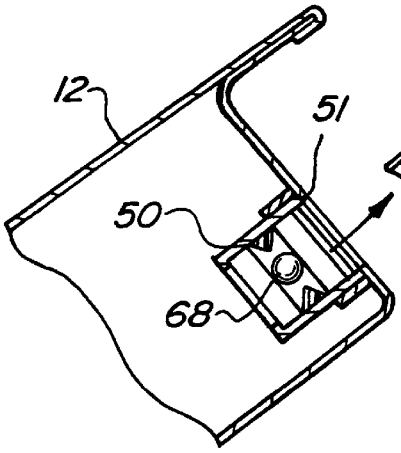

SELF LOCATING CHECK ARM ASSEMBLY

BACKGROUND OF THE INVENTION

1. Field of the Invention

The present invention relates to a check arm assembly for cargo doors of a vehicle, and more particularly, to a self locating check arm assembly which can be disengaged and reengaged to the door automatically.

2. Description of Background Art

In hingedly supported vehicle doors, such as the rear or side cargo doors of a van, it is common to provide a check arm assembly that maintains the door at an opened position of approximately 90°. The check arm assemblies are designed to provide a stop position for the cargo doors so that the doors are prevented from swinging all the way open (full open). In addition, the check arm assemblies are also designed to maintain the door at an open position so that cargo may be easily loaded without the door swinging closed. It is often desirable, however, to be able to open the door farther to a fully opened position, beyond the approximately 90° opened position, so that the door can be swung fully clear of the door aperture or pillar. Thus, it is desirable to provide a check arm assembly which can be disengaged to allow the door to swing to a fully open position.

A known door check is disclosed in U.S. Pat. No. 4,663,801 to Malopolski, Jr. in which a door check is disclosed which provides a positive stop at a hold-open position, as well as being disengageable to provide a fully opened position, and is automatically reengageable upon door closing. A check strap is pivotally mounted to a vehicle body and resiliently biased into sliding engagement with a stop pin fixed to the vehicle door. As the door is opened, the stop pin slides along a working surface of the check strap, and into a catch portion hook to block the stop pin and provide a positive stop to maintain the door at a hold-open position. The door may be moved back toward the closed position to move the stop pin out of the hook, and the check strap is moved by an external force away from the stop pin enough so that the stop pin will miss the hook as the door is moved back to the hold-open position. From there, the door can be moved to a fully opened position, as the stop pin slides along the surface of a keeper portion on the check strap. The keeper portion surface is oriented so that the stop pin will slide over the catch portion and automatically back into engagement with the working surface under the resilient bias as the door is closed. A problem with the device of Malopolski, Jr. is that the door check is not capable of automatically disengaging from the door. In other words, an external force is required to move the check strap away from the stop pin enough that the stop pin will miss the hook as the door is moved to the hold-open position.

Thus, it is desirable in the art of door checks to provide a check arm that can automatically disengage and reengage with the vehicle door to allow the door to swing to a fully open position.

SUMMARY OF THE INVENTION

Accordingly, it is an object of the present invention to provide a check arm assembly which is capable of disengaging and reengaging to the door automatically.

It is another object of the present invention to provide a check arm assembly which is quiet in operation.

It is yet another object of the present invention to provide a check arm assembly which reliably holds a vehicle door in an approximately 90° opened position.

It is still another object of the present invention to provide a check arm assembly which is simple in structure inexpensive to manufacture, easy to mass produce, durable in use and refined in appearance.

These and other objects of the present invention are obtained by providing a self locating check arm assembly, including an elongated arm pivotally mounted to a hinge base portion. A spring is provided for biasing the elongated arm toward a first position. A housing portion is provided having an opening therethrough for receiving the elongated arm. The housing supports arm engaging portions and is adapted to be mounted to a door of a vehicle. A surface locator defines the first position against which the elongated arm is biased by the spring. The self locating check arm allows a door to be fully opened without disabling the check arm, whereby when the door is opened beyond a predetermined position, the elongated arm disengages from the housing and the elongated arm is biased against the surface locator such that an end of the elongated arm is properly aligned with the opening in the housing when the door is returned to the predetermined position and is automatically reengaged with the housing when the door is moved beyond the predetermined position toward a closed position.

The prior art devices do not allow the customer to open the door fully open without disabling the door check. Furthermore, once the prior art door checks have been disabled, it is left that way to be manually reconnected in many prior art devices. In other prior art door check devices, such as disclosed in U.S. Pat. No. 4,663,801, manual disengagement of the check arm is required in order to allow the cargo door to fully open. The self locating check arm assemblies according to the present invention can disengage and reengage to the door, automatically, without the necessity of any action aside from swinging the door to its different opened positions (approximately 90° and fully opened).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention, and wherein:

FIG. 7 is a sectional view of the door, body structure, and the check arm assembly according to a second embodiment of the present invention wherein a clip member is provided for holding the check arm in a predetermined position;

FIG. 8 is a sectional view as in FIG. 7, but showing the door moved from the hold-open position to a fully opened position wherein the door is disengaged from the check arm assembly and the check arm is held in place by a clip member; and FIG. 9 is a side view of a clip member used in accordance with the second embodiment of the present invention.

DETAILED DESCRIPTION OF THE PREFERRED EMBODIMENTS

The present invention relates to a self locating check arm assembly 10 which is capable of automatically disengaging and reengaging with a vehicle door 12.

Figure 1:
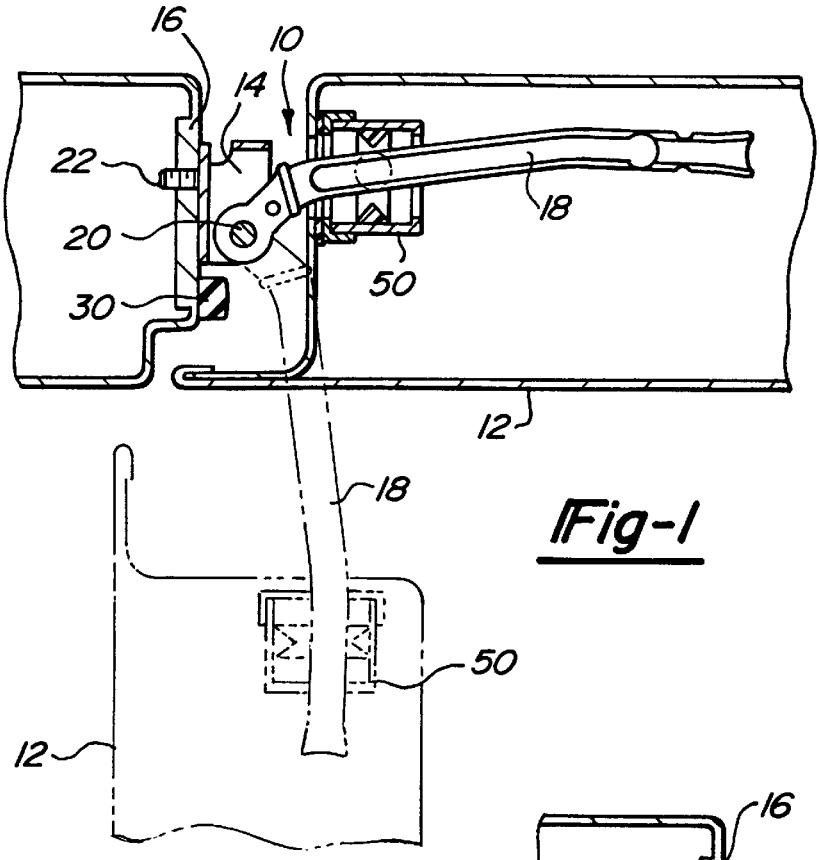
FIG. 1 is a sectional view of the door, body structure, and the check arm assembly of the present invention, showing the door in the closed position and in the hold-open position shown in dotted lines.
Figure 2:
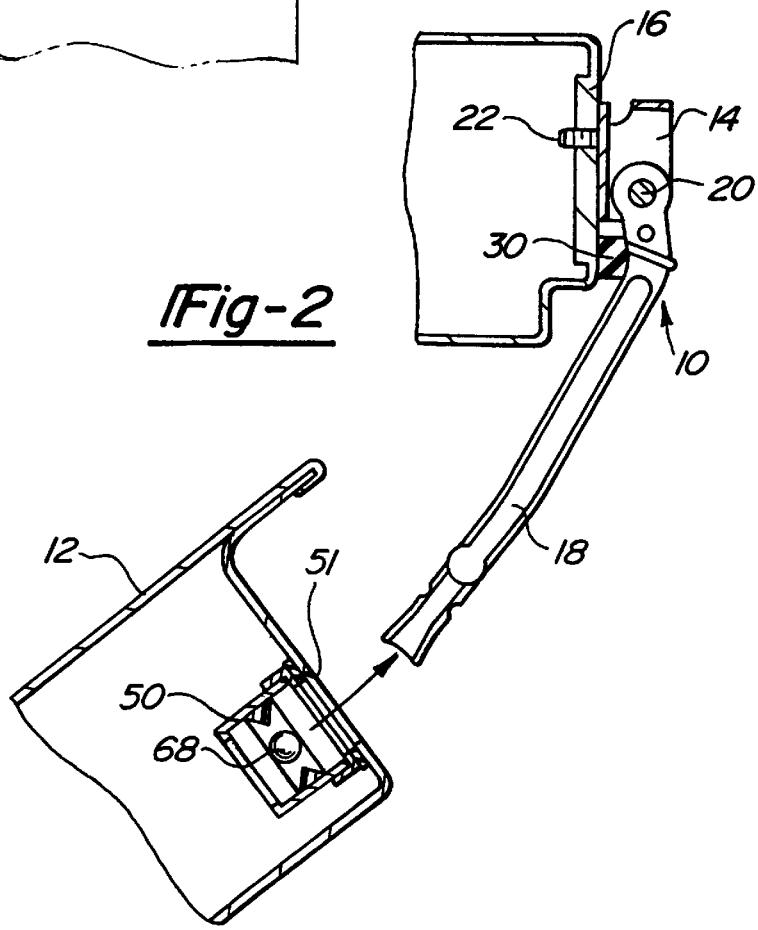
FIG. 2 is a sectional view as in FIG. 1, but showing the door moved from the hold-open position to a fully opened position wherein the door is disengaged from the check arm assembly.

With reference to FIGS. 1 and 2, self locating check arm assembly 10 includes a hinge base portion 14 which is adapted to be mounted to a vehicle pillar 16 within a cargo door aperture of a vehicle. A check arm 18 is pivotally attached to hinge base portion 14 by a pivot pin 20. Hinge base portion 14 is secured to the vehicle pillar 16 by bolts 22, one of which is shown.

Figure 3:
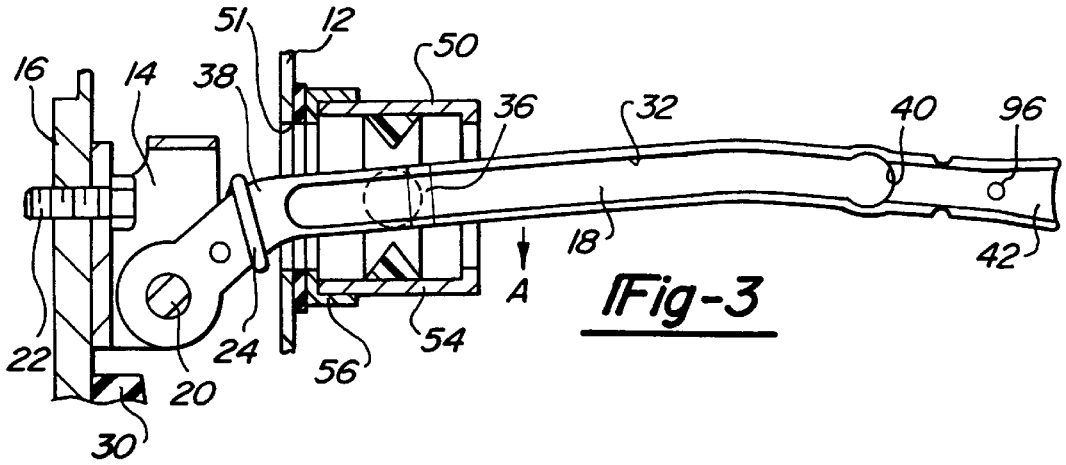
FIG. 3 is a cross-sectional view along a horizontal plane, of the check arm assembly according to a first embodiment of the present invention.
Figure 4:
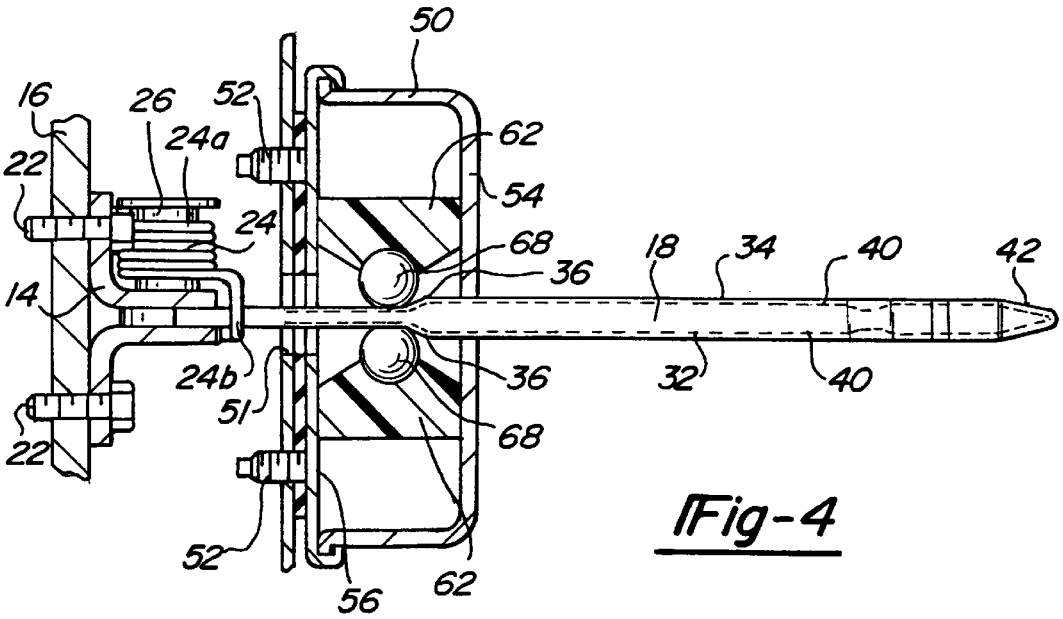
FIG. 4 is a cross-sectional view along a vertical plane of the check arm assembly shown in FIG. 3.

As shown in FIG. 4, a check arm spring 24 is provided for biasing check arm 18 toward a first direction. Check arm spring 24 is supported on a spring support shaft 26 which may be concentric with pivot pin 20. Check arm spring 24 is a helical torsion spring having a first arm portion 24*a* which engages hinge base portion 14 and a second arm portion 24*b* which engages check arm 18 and biases check arm 18 in a direction indicated by arrow A, as shown in FIG. 3. A surface locator 30 is optionally provided for providing a stop for supporting check arm 18 in a predetermined position, as shown in FIG. 2. Check arm spring 24 biases check arm 18 toward the predetermined position defined by surface locator 30. Surface locator 30 is preferably a rubber-type stop device. Depending on the configuration of the door aperture of a vehicle, a surface locator 30 may or may not be necessary. In other words, the door frame may be configured such that the door frame itself provides a sufficient stop surface for locating the check arm 18 in the predetermined position.

With reference to FIGS. 3 and 4, check arm 18 is provided with first and second grooves 32, 34 on opposite sides thereof. Each groove 32, 34 is provided with a first cam portion 36 adjacent to a first end portion 38 which is attached to hinge base portion 14. Each groove 32, 34 is also provided with a detent 40 near a tapered end 42 thereof.

With continued reference to FIGS. 3 and 4, check arm 18 is adapted to be received within a housing 50 which is attached to cargo door 12 which is hingedly attached to a vehicle body. Housing 50 is securely mounted within cargo door 12 by a plurality of fasteners 52. Cargo door 12 is provided with an opening 51 through which check arm 18 passes for engaging housing 50.

Figure 5:
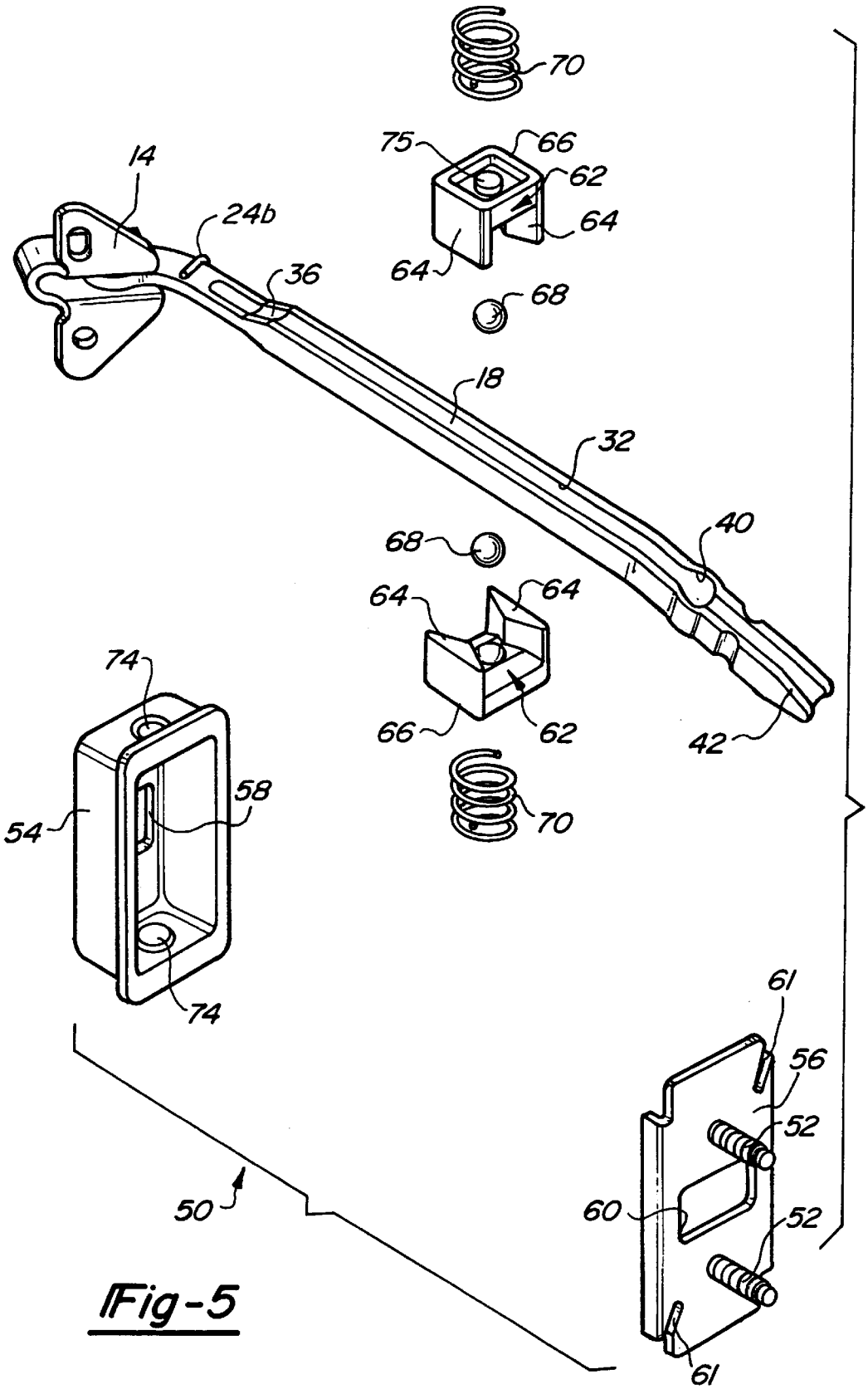
FIG. 5 is an exploded perspective view of the housing assembly and check arm according to a first embodiment of the present invention wherein balls are used for engaging the check arm.

With reference to FIG. 5, housing 50 includes a first housing member 54 and a housing cover plate 56 fastened to first housing member 54. First housing member 54 and housing cover plate 56 are each provided with an opening 58 and 60, respectively, for receiving check arm 18. Housing cover plate 56 is provided with a pair of diagonal slots 61 which facilitate drainage of the housing 50.

A pair of ball guide members 62 are provided within housing 50. Each ball guide member 62 includes appendages 64 and flange 66. Appendages 64 help to guide ball guide members 62 within housing 50. A pair of check arm engaging balls 68 are supported by ball guide members 62 within housing 50. Check arm engaging balls 68 engage grooves 32, 34 of check arm 18 when check arm 18 is received in housing 50. Each ball guide member 62 is biased by a pair of housing springs 70 toward the other ball guide member 62. Housing 50 is provided with seat portions 74 at each end thereof for providing a seat for housing springs 70. Ball guide members 62 are also provided with projections 75 for centering housing springs 70 against ball guide members 62.

With reference to FIGS. 1 and 2, the operation of self locating check arm assembly 10 will be described. When cargo door 12 is in a closed position such as shown in FIG. 1, check arm 18 passes through opening 51 in cargo door 12 and through openings 58, 60 in housing 50. Furthermore, check arm engaging balls 68 are each biased by housing springs 70 against grooves 32, 34 of check arm 18. When door 12 is opened to an approximately 90° opened position as shown in phantom in FIG. 1, housing 50 will have moved along with door 12 to a position relative to check arm 18 such that check arm engaging balls 68 engage detents 40, as shown. Because of the biasing force of housing springs 70, check arm engaging balls 68 engage detents 40 to maintain door 21 in an opened position as long as the forces applied to door 12 do not overcome the biasing force of housing springs 70 to allow check arm engaging balls 68 to disengage from detents 40. If the user of the vehicle desires to open the door completely open, i.e., 130°–180°, the user pulls door 12 with enough force to overcome the biasing force of housing springs 70 on check arm engaging balls 68. When this happens, tapered end 42 of check arm 18 disengages from check arm engaging balls 68 and door 12 is allowed to swing freely to a fully opened position, as shown in FIG. 2.

When door 12 is opened such that check arm 18 disengages from housing 50, check arm spring 24 causes check arm 18 to rest against surface locator 30. Surface locator 30 supports check arm 18 in a predetermined position such that when door 12 is moved toward a closed position from its fully opened position, check arm 18 is automatically properly aligned to reengage with opening 51 in door 12 and openings 58, 60 in housing 50. Check arm 18 then passes between check arm engaging balls 68 such that self locating check arm assembly 10 is reengaged automatically.

Figure 6:
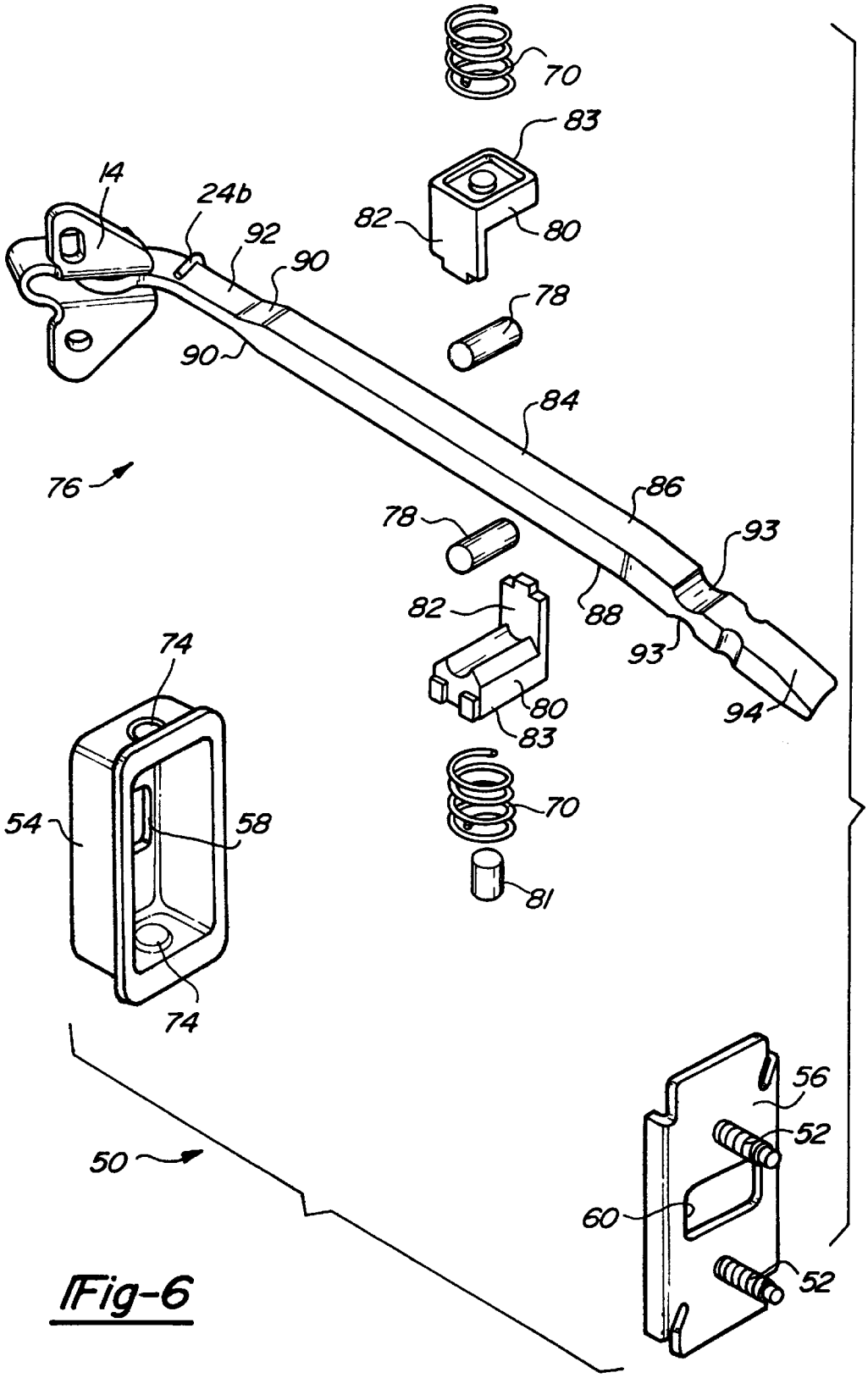
FIG. 6 is an exploded perspective view of the housing assembly and check arm according to a alternative embodiment of the present invention wherein rollers are used for engaging the check arm.

An alternative embodiment of the present invention is shown in FIG. 6. In particular, FIG. 6 illustrates an exploded perspective view of a door check arm assembly 76 wherein check arm engaging rollers 78 are used in place of check arm engaging balls 68 disclosed in the first embodiment. Door check arm assembly 76 includes a housing 50 having a first housing member 54 and a housing cover plate 56 fastened to first housing member 54.

Housing 50 encloses a pair of roller guide members 80 each having an appendage 82 and flange 83. A pair of springs 70 are disposed for biasing roller guide members 80 toward one another. A rubber or foam-like cylinder 81 can optionally be provided for inserting inside of helical type springs 70. The cylinder 81 would operate as a dampening member for the springs 70 so that the housing 50 can be made to be more quiet in operation. It is noted that one cylinder 81 is shown as an example in FIG. 6, however the cylinder 81 can also be utilized along with the housing assembly illustrated in FIG. 5. Furthermore, the cylinder 81 can be made of suitable materials other than rubber or foam and does not necessarily have to be cylindrical in shape.

Housing 50 is adapted to be fastened by fastening screws 52 to a door 12. The housing 50 therefore is adapted to be fastened within the door 12 and a check arm 84 is received within housing 50. Check arm 84 is provided with generally flat oppositely facing surfaces 86 and 88 which are engaged by rollers 78. Each of surfaces 86 and 88 are provided with a first detent portion 90 located adjacent to a first end 92 of check arm 84, and a second detent portion 93 which corresponds to the approximately 90° open position. An end 94 of check arm 84 is pointed so as to better facilitate alignment of check arm 84 with housing 50 during reengagement.

Check arm 84 is provided with a check arm spring 24 for biasing check arm 84 to a predetermined position for automatically aligning check arm 84 with housing 50 when door 12 has been opened to a fully open position.

As is apparent from the above description, the self locating check arm assemblies (10, 76) give the user the ability to open a cargo door 130°–180° (fully open) without disabling the check arm assembly. The check arms (18, 84) can be disengaged and reengaged to the door (12) automatically. The check arms (48, 84) reengage the housing (50) by using a surface locator 30 to hold the check arms (18, 84) in the predetermined position which is assured by spring 24.

As shown in FIG. 3, check arm 18 may be provided with a hole 96 therethrough near tapered end 42 which is capable of receiving a pin (not shown) to prevent check arm 18 from disengaging from housing 50. The pin would be designed to be larger than openings 58 and 60 so that check arm 18 cannot disengage from housing 50. The pin is especially useful when the vehicle is being transported in order to ensure that the door cannot be swung all the way open. Upon receipt of the vehicle, a purchaser can simply remove and discard the pin to enable the door to function as designed.

FIGS. 7–9 illustrate a second embodiment of the present invention. In FIGS. 7 and 8 like reference numerals are used to designate like elements as described with respect to FIGS. 1–6 as discussed above. However, according to the second embodiment, the check arm spring 24 and the surface locator have been eliminated and a clip member 100 has been provided in order to secure check arm 18 in the predetermined position for reengagement with housing assembly 50. With respect to FIG. 9, clip member 100 is provided with base portion 102 which is secured to the pillar 16. One method of securing the clip member 100 to the pillar 16 is providing the clip member 100 with a "Christmas tree-type" snap-in portion 104 for engaging a hole in the pillar 16. A pair of check arm engaging arms 108 are provided for friction locking check arm 18 in the predetermined position for aligning the check arm 18 with the housing assembly 50 when the door 12 is moved from a full open position to a closed position, as shown in FIG. 8. Thus, when the door 12 is moved from the intermediate open position as shown in phantom lines in FIG. 7 to the full open position as shown in FIG. 8, check arm 18 becomes frictionally locked between arms 108 of clip member 100 so that proper alignment of the check arm 18 with the housing assembly 50 is assured for reengagement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A self locating check arm assembly, comprising;

a base portion adapted to be mounted to a vehicle body, an elongated arm pivotally mounted to said base portion, an engagement member on said arm adjacent a free end of said arm;

a spring biasing said elongated arm toward a first arm position;

a housing portion having an opening therethrough for receiving said elongated arm, said housing portion supporting an active arm engaging portion for releasably coupling with said arm engagement member for holding a door of a vehicle in a first open position and said housing portion adapted to be mounted to the door of the vehicle and said elongated arm having a configuration between said arm engaging member and said free end, including said free end, which enables unimpeded removal of said elongated arm from said housing portion as the door is moved to a second open position beyond said first open position and said free end automatically reengaging said housing portion as the door is moved back to its first open position.

2. The assembly according to claim 1, further comprising surface locator means against which said elongated arm is biased by said spring for defining said first arm position.

3. The assembly according to claim 1, wherein said arm engaging portions include a pair of balls which are biased toward one another by a pair of springs.

4. The assembly according to claim 1, wherein said arm engaging portion includes a pair of rollers which are biased by springs toward one another by a pair of springs.

5. The assembly according to claim 1, wherein said elongated arm engagement member including a pair of grooves on two side surfaces thereof.

6. The assembly according to claim 5, wherein said elongated arm free end is a tapered end.

7. The assembly according to claim 5, wherein at least one of said elongated arm grooves is provided with a detent for holding a vehicle door in said first position.

8. The assembly according to claim 1, wherein said elongated arm free end is provided with a tapered end.

9. The assembly according to claim 1, wherein said elongated arm engagement member is provided with a detent.

10. A self locating check arm assembly, comprising;

a base portion adapted to be mounted to a vehicle body;

an elongated arm pivotally mounted to said base portion, an engagement member on said arm adjacent a free end of said arm, said elongated arm having a portion between said arm engaging member and said free end, including said free end;

a spring biasing said elongated arm toward a first arm position;

a housing portion having an opening therethrough for receiving said elongated arm, said housing portion supporting an active arm engaging portion for releasably coupling with said arm engagement member for holding a door of a vehicle in a first open position and said housing portion adapted to be mounted to the door of the vehicle;

wherein said self locating check arm assembly allows the door to be fully opened beyond its first open position whereby when said door is fully opened beyond the first position, said elongated arm portion between said arm engaging member and said free end, including said free end, enables unimpeded disengagement from said housing and said elongated arm is biased by said spring to said first arm position such that said free end of said elongated arm is properly aligned with said opening in said housing when said door is returned from the fully opened position to the first open position and is automatically reengaged with said housing when said door is moved beyond said first open position toward a closed position.

11. The assembly according to claim 10, further comprising surface locator means against which said elongated arm is biased by said spring for defining said first arm position.

12. The assembly according to claim 10, wherein said arm engaging portion includes a pair of balls which are biased toward one another by a pair of springs.

13. The assembly according to claim 10, wherein said arm engaging portion includes a pair of rollers which are biased by springs toward one another by a pair of springs.

14. The assembly according to claim 10, wherein said elongated arm engagement member is provided with a pair of grooves on two side surfaces thereof.

15. The assembly according to claim 14, wherein said elongated arm free end is provided with a tapered end.

16. The assembly according to claim 14, wherein said elongated arm groove is provided with a detent for holding a vehicle door in a predetermined position.

17. A self locating check arm assembly, comprising;

a base portion adapted to be mounted to a vehicle body;

an elongated arm pivotally mounted to said base portion, an engagement member on said arm and said arm having a free end;

a clip member mounted to said vehicle body and adapted to receive and hold said elongated arm in a predetermined position; and a housing portion having an opening therethrough for receiving said elongated arm, said housing portion supporting an arm engaging portion for releasably coupling with said arm engagement member for holding a door of a vehicle in a first open position and said elongated arm having means thereon configured for enabling unimpeded disengagement of an arm portion between said arm engagement member and said free end, including said free end, from said arm engaging portion when the door is opened beyond the first portion and said housing portion adapted to be mounted to a door of a vehicle.

18. The self locating check arm assembly according to claim 17, wherein said self locating check arm assembly allows a door to be fully opened without disabling said check arm whereby when said door is opened beyond a predetermined position, said elongated arm disengages from said housing and said elongated arm is held by said clip member in said predetermined position such that an end of said elongated arm is properly aligned with said opening in said housing when said door is returned from a fully opened position to a first position and is automatically reengaged with said housing when said door is moved beyond said first position toward a closed position.

* * * * *